United States Patent [19]

Lautenschläger

[11] 4,247,965

[45] Feb. 3, 1981

[54] OVER-CENTER HINGE

[75] Inventor: Karl Lautenschläger, Reinheim, Fed. Rep. of Germany

[73] Assignee: Karl Lautenschläger KG, Möbelbeschlagfabrik, Reinheim, Fed. Rep. of Germany

[21] Appl. No.: 51,033

[22] Filed: Jun. 22, 1979

[30] Foreign Application Priority Data

Jun. 26, 1978 [DE] Fed. Rep. of Germany ..... 2828052

[51] Int. Cl.[3] ..... E05D 11/10

[52] U.S. Cl. ..... 16/145; 16/163

[58] Field of Search ..... 16/145, 180, 159, 163, 16/164

[56] References Cited

U.S. PATENT DOCUMENTS

| | | | |
|---|---|---|---|
| 4,091,500 | 5/1978 | Lautenschlager | 16/145 |
| 4,187,580 | 2/1980 | Lautenschlager, Jr. | 16/145 |

FOREIGN PATENT DOCUMENTS

| | | | |
|---|---|---|---|
| 840059 | 4/1970 | Canada | 16/145 |
| 2016398 | 4/1970 | Fed. Rep. of Germany | 16/145 |
| 2122857 | 5/1971 | Fed. Rep. of Germany | 16/145 |

*Primary Examiner*—H. Hampton Hunter

[57] ABSTRACT

Over-center hinge for furniture doors, in which one of the hinge parts has a mortise cup manufactured of plastic, from whose circumferential wall a diagonally disposed tongue which is integral with the mortise cup and can be flexed against spring bias, projects into the interior of the mortise cup, and on which, during a portion of the movement of the hinge, a contact surface provided on the other hinge part at its end facing the pivot, slides and can be moved in an intermediate position through a dead point on one side of which it urges the door to the closed position and on the other side of which it exerts a pressure in the opening direction. The contact surface is so disposed that, in the closed position, it lies in the direct vicinity of the pivot axis of the tongue. The upper end of the tongue is integrally joined by a resiliently flexible section to the mortise cup, and the bottom free end of the tongue which is originally made in an approximately parallel position with respect to the circumferential wall has two short projections projecting laterally in opposite directions. The projections are snapped into lateral recesses associated with them in the transition area from the bottom to the circumferential wall of the cup such that the tongue is bent from its originally parallel position with respect to the circumferential wall into the diagonal position and placed under bias.

5 Claims, 4 Drawing Figures

FIG. 3
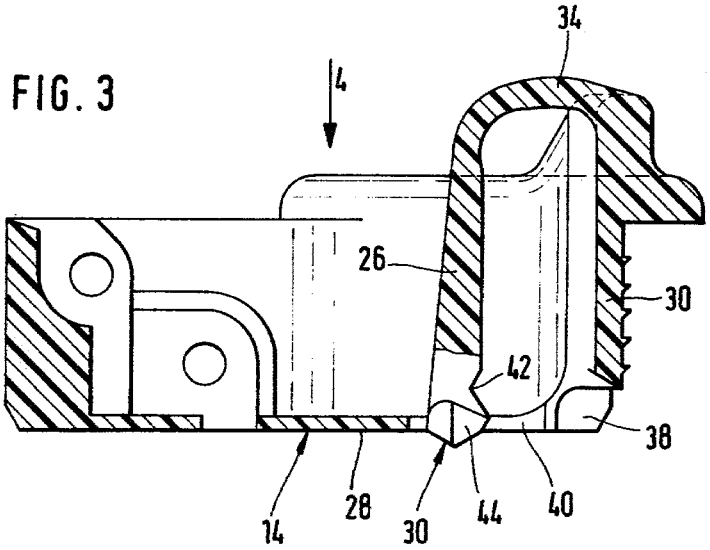
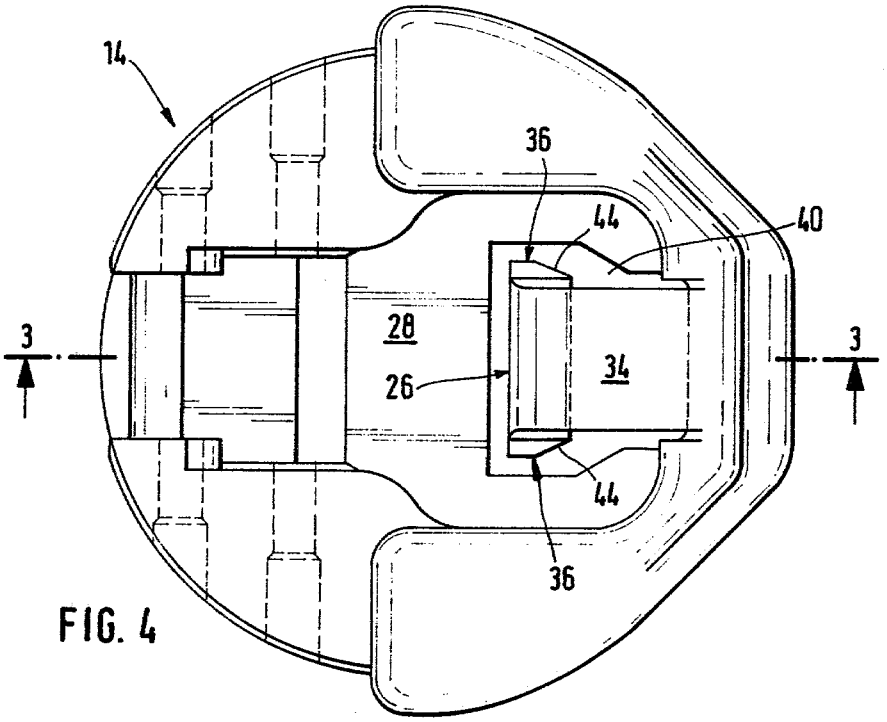
FIG. 4

OVER-CENTER HINGE

BACKGROUND

The invention relates to an over-center hinge for cabinet doors, in which one of the parts has a mortise cup made of plastic, from whose circumferential wall a tongue which is integral with the mortise cup, projects diagonally into the interior of the mortise cup and can yield against spring bias, and on which a contact surface provided on the other hinge part at its end facing the pivot glides during a portion of the swing of the hinge and is movable in an intermediate position through a dead center on one side of which it urges the door to the closed position and on the other side of which it exerts a pressure in the opening direction, the contact surface being so disposed that in the closed position it is situated in the immediate vicinity of the pivot axis of the tongue.

An older hinge of this kind is known (German Pat. No. 2,016,398) in which the tongue, stiffened on its back by ribs, lies in a cut-out in the circumferential wall, merging integrally at its bottom end with the bottom of the mortise cup. The spring force of the tongue holding the hinge in the closed position is produced in this hinge by the resilient flexing of the area where the bottom and tongue join, which simultaneously forms the pivot axis of the tongue, and by an elongated, curved leaf spring injection molded on the upper end of the tongue. This hinge has proven practical on account of its good door-holding power resulting from the favorable leverage ratio in the closed position. Since the mortise cup is made in one piece with the tongue out of plastic, it is also relatively inexpensive. In the case of hinges for heavy doors, however, where an especially strong holding power is required, the leaf spring assisting the spring force of the tongue has to be relatively long, so that the leaf spring support opposite the tongue has to be disposed at a considerable distance outside of the mortise cup. For this reason, a relatively elongated flange is provided on the side of the mortise cup away from the hinge pivot, and on it the leaf spring is supported. The relatively compact dimensions of the mortise cup resulting from the arrangement of the tongue within the cut-out in the circumferential wall are thereby increased, and this is not desirable, inasmuch as the projecting flange and the leaf spring are visible when the door is open and they project the inside surface of the door. In certain, though rare, cases, the flexing of the tongue, which is substantially limited to the area where the bottom end of the tongue joins the bottom of the mortise cup, has caused the tongue to break off from the bottom as the plastic material becomes aged and embrittled, so that in a later period the manufacturers ceased to mold the tongue in one piece in this area with the floor of the mortise cup, and instead a separate pivot eye was provided on the tongue, which was then mounted in the cup with a pivot pin (German Pat. No. 2,122,857). This, however, complicates and increases the cost of the manufacture of the mortise cup on account of the pivot pin and the installation thereof.

THE INVENTION

It is the object of the invention to create an overcenter hinge having a plastic mortise cup with integrally injection-molded tongue, whose over-center mechanism is at least equal to that of the known hinge in its closing and holding function, but in which the use of a separate pivot pin for the pivoting of the tongue in the mortise cup is not necessary and nevertheless breakage due to the aging of the plastic is prevented. Furthermore, the overall dimensions of the mortise cup are to be further reduced.

Setting out from a hinge of the kind mentioned above, this object is achieved in accordance with the invention in that the upper end of the tongue is integrally joined by a resiliently flexible section to the mortise cup, and that the lower, free end of the tongue, which is first manufactured in an approximately parallel position with respect to the circumferential wall, has two short projections protruding laterally in opposite directions, which are snapped into associated recesses in the area where the bottom joins the circumferential wall of the mortise cup such that the tongue is flexed from its original position parallel to the circumferential wall to the diagonal position and set under bias. In the flexing movement of the tongue during the over-center action, the lateral projections can turn in the corresponding recesses, so that they therefore assume the function of the separate pivot pin. The breaking off of the tongue in the area where the flexing takes place in therefore impossible. Due to the fact that, when the tongue is snapped into the recesses, it is already placed under bias, a spring force sufficiently great for heavy doors is available from the beginning of the over-center action, which assures a perfect closing and holding function as a result of the favorable leverage, which is equal to that of the known hinges. There is no need, either, to fear that the tongue will be pulled out of the recesses in the mortise cup after the hinge has been installed, because the mortise cup is then held under tension in the corresponding mortise in the cabinet door, and the spreading of the mortise cup, which is necessary for the escape of the projections from the recesses is no longer possible.

In a preferred further development of the invention, the bottom of the mortise cup has underneath the tongue an opening which extends all the way to the bottom portion of the circumferential wall, and from which the lateral recesses for the tongue projections extend outwardly, the circumferential wall being uninterrupted in the area behind the tongue, and the back of the tongue being supported in its bottom end area against the continuous circumferential wall. The continuous circumferential wall results in a comparatively greater stability of the mortise cup in the sense that a tighter press fitting in the corresponding mortise in the door can be achieved. Due to the engagement of the bottom end of the tongue with the circumferential wall, the closing and holding forces acting in the tongue are also perfectly supported on the mortise cup.

Whereas in the known hinge the tongue itself was deliberately stiffened by ribs, so that the spring force of the tongue was in this case produced substantially only in the area of transition between the tongue and the bottom of the mortise cup and by the leaf spring, provision is furthermore made in accordance with the invention for the tongue to be made also resiliently flexible in its diagonal portion within the mortise cup. When the contact surface glides along the slanting tongue, the tongue can therefore flex slightly towards the circumferential wall, so that the spring force is produced not exclusively by the resiliently flexible upper section but also by the tongue itself.

To facilitate their snapping into the recesses in the mortise cup, the lateral projections of the tongue can be provided with ramp surfaces sloping outwardly from the interior of the cup and inwardly toward one another, which wedge the cup open in the area of the recesses to allow the projections to be snapped into place. The tongue projections are, as a rule, snapped into the corresponding recesses in the mortise cup when the hinge is installed, this being accomplished either automatically or by a brief pressure on the bottom end of the tongue in the engaging direction, according to whether the installation is performed entirely or partially on automatic apparatus or by hand. In any case, the installation is easier than when a tongue has to be mounted on a separate pivot pin.

The invention will be further explained in the following description of an embodiment thereof, in conjunction with the drawing wherein:

FIG. 3 is an enlarged cross-sectional view taken in the same manner as in FIG. 2 through the cup of the hinge, wherein the tongue is not in the position in which it is flexed and locked in the cup, and FIG. 4 is a top plan view of the cup as seen in the direction of the arrow 4 in FIG. 3.

Figure 1:
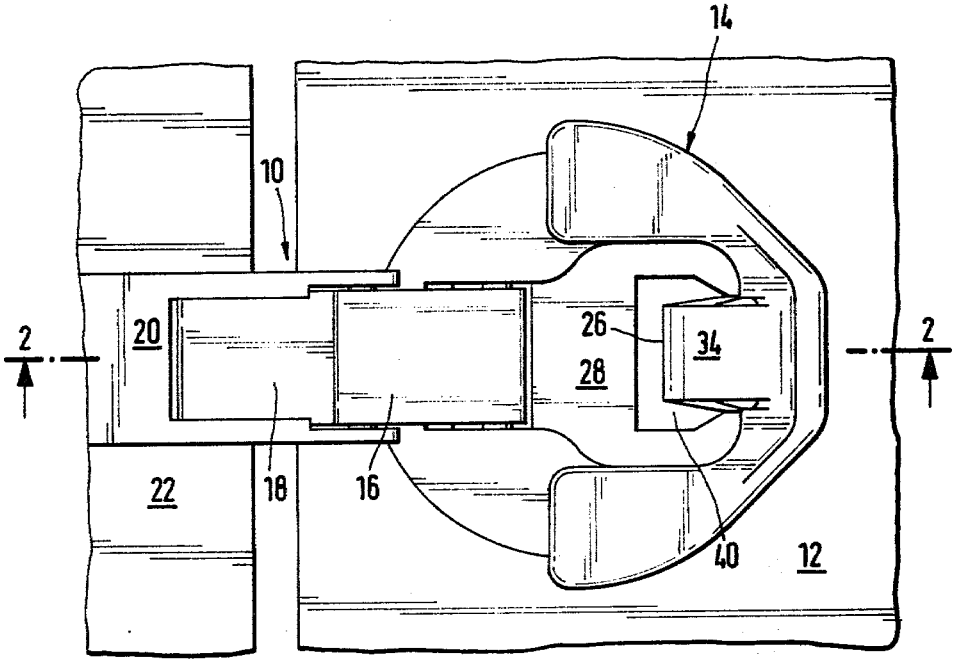
FIG. 1 is a top plan view of a hinge of the invention, in which the door that is hung by the hinge is in the open position.
Figure 2:
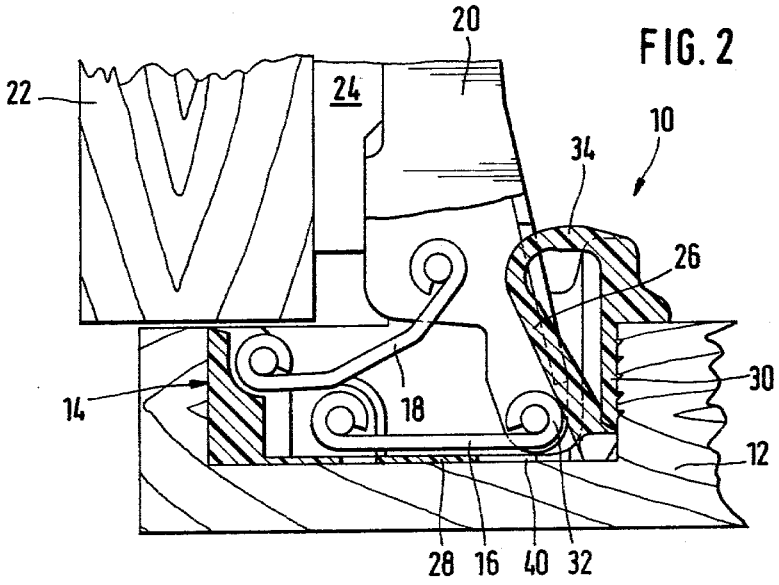
FIG. 2 is a cross-sectional view through the hinge as seen in the direction of the arrows 2—2 in FIG. 1, the hinge being in the closed position.

The over-center hinge generally designated as 10 in FIGS. 1 and 2 is, in the illustrated instance, what is known as a four-pivot hinge whose door-related part, which is in the form of a cup 14 which can be fastened in a mortise in a cabinet door 12, is pivotingly coupled by two hinge links 16 and 18 to the supporting-wall-related part having an elongated supporting arm 20. The supporting arm 20 is adjustably fastened in a conventional manner on a mounting plate 24 attached to the supporting wall 22 of the cabinet on which the door 12 is hung.

The over-center mechanism holding the door 12 in the closed position is formed by a resiliently biased tongue 26 which can be flexed against its bias, which is disposed within the mortise cup 14 on the side thereof opposite the pivot eyes of the hinge links 16 and 18 i.e., on the side away from the edge of the door, and which extends upwardly from the area where the bottom 28 meets the circumferential wall 30. When the cup 14 is swung from the open position represented in FIG. 1 to the closed position shown in FIG. 2, the pivot eye 32 on the supporting-arm end of the hinge link 16 moves from a certain angular position to the upper end of the tongue 26. As soon as the pivot eye 32 has come into engagement with the tongue 26, it slides downwardly over the face of the tongue 26 and forces the tongue, as the closing movement continues, against the spring bias acting on it, in a clockwise direction with respect to FIG. 2, until a dead-center position is reached, beyond which the tongue reflexes counterclockwise, thereby exercising a force acting in the closing direction on the pivot eye 32. In the closed position, the pivot eye 32 then is situated in the direct vicinity of the lower end of the tongue, although the tongue has not yet returned all the way to the left-hand limit position, and therefore it exercises a constant closing pressure on the pivot eye 32. The door 12 hung with the hinge of the invention is therefore urged resiliently in the closed position.

The upper end of the tongue 26 is integrally joined by a resiliently flexible section 32 to the upper edge of the mortise cup 14, i.e., the tongue 26 consists of the same plastic material as the cup and is injection-molded integrally therewith. The lower end of the tongue, however, is not integral with the bottom 28 or with the circumferential wall 30 of the mortise cup, but instead has two short projections 36 extending laterally in opposite directions, which can be engaged in associated recesses 38 (see FIG. 3) provided in the area where the bottom 28 and the wall 30 of the mortise cup 14 meet. The projections 36 engaged in the recess 38 constitute short studs integral with the tongue, about which the tongue pivots. The tongue, as stated above, is to be under bias, and this is achieved by the fact that when the mortise cup is manufactured, the tongue is injection molded initially in the position shown in FIG. 3, parallel to the circumferential wall 30, and then, with resilient flexing of section 34 and, to a lesser extent, of the tongue 26 itself, it is bent to the position best seen in FIG. 2, where it is then held by the projections 36 engaging in the recesses 38.

Manufacturing the mortise cup 14 first with the tongue extending parallel to the circumferential wall 30 has a technical purpose in addition to the purpose stated above of placing the tongue under bias, and that is that only with the tongue in this position is it possible to strip the mortise cup from the injection molding die, the die having to have a core between the back of the tongue and the circumferential wall, which is extracted downwardly through an opening 40 in the bottom 28 (see FIG. 3) when the cup 14 is removed from the mold. Since the recesses 38 are also formed simultaneously by this core, it is clear that these recesses can have no undercuts in the direction in which the core is extracted. The recesses 38, therefore, are open at the bottom, and also open towards the circumferential wall, so that at first one might have the impression that the end of the tongue can emerge downwardly and radially outwardly from the recesses 38. Actually, however, as it can be seen in FIG. 2, this is not possible, because the walls of the mortise receiving the cup in the door 12 prevent the end of the tongue from coming through in these directions. The radial outward movement of the bottom end of the tongue is furthermore also prevented by the fact that the back of the tongue 26, in the area 42 above the projections 36, is shaped such that at this area 42 it engages the circumferential wall 30 where the latter passes behind the tongue.

The bending of the tongue to the diagonal biased position is performed when the hinge is installed, and it can be accomplished either automatically or by hand.

The engagement of the projections 36 in the recesses 38 is assisted by ramp surface sections 44 on the projections 36, which by wedging action expand the cup which is rendered slightly elastic adjacent the recesses 38 as a result of the opening 40 in the bottom, until the projections 36 are aligned with the recesses 38 and snap into them.

I claim:

1. An over-center hinge for a furniture door, having first and second hinge parts, one of the hinge parts having a mortise cup of synthetic material with a bottom and a circumferential wall, a diagonally disposed tongue which is integral with the mortise cup, has a pivot axis, and can be flexed against spring bias, projecting from said wall into the interior of the mortise cup; during a portion of the movement of the hinge, a contact surface provided on the other hinge part as its end facing the pivot axis, sliding on said tongue; said tongue being movable in an intermediate position through a dead point on one sie of which it urges the door to a closed position and on the other side of which it exerts a pressure in the opening direction, said contact surface being so disposed that in the closed position, it lies in the direct vicinity of the pivot axis of the tongue, said tongue having an upper end whih is integrally joined by a resiliently flexible section to the mortise cup, said tongue also having a lower free end which originally extends in an approximately parallel position with respect to the circumferential wall and has two short projections projecting laterally in opposite directions, said projections being snapped into lateral recesses associated with them in the transition area from the bottom to the circumferential wall of the cup such that the tongue is bent from its originally parallel position with respect to the circumferential wall into the diagonal position and placed under bias.

2. An over-center hinge according to claim 1, wherein said bottom of the mortise cup has underneath the tongue an opening carried all the way into the bottom area of the circumferential wall, from which the lateral recesses for the projections of the tongue extend, said circumferential wall being without interruption in the area behind the tongue, the lower end area of the back of the tongue being supported against the continuous circumferential wall.

3. An over-center hinge according to claim 1, wherein said tongue is of resiliently deformable construction in its diagonal area extending within the cup.

4. An over-center hinge according to claim 2, wherein said tongue is of resiliently deformable construction in its diagonal area extending within the cup.

5. An over-center hinge according to any one of claims 1 to 4, wherein in order to facilitate snapping into the recesses in the cup, the lateral projections of the tongue have at their oppositely pointing ends surface sections sloping radially outwardly from the cup interior and toward one another.

* * * * *